United States Patent [19]

Lermer

[11] 4,146,212

[45] Mar. 27, 1979

[54] METAL RAILING

[76] Inventor: Willi Lermer, Theodor Haubach Strasse 5-7, 62 Wiesbaden, Fed. Rep. of Germany

[21] Appl. No.: 803,688

[22] Filed: Jun. 6, 1977

[30] Foreign Application Priority Data

Feb. 23, 1977 [DE] Fed. Rep. of Germany ..... 2707704

[51] Int. Cl.[2] ..... E04H 17/14; E04F 11/18; E01D 19/10

[52] U.S. Cl. ..... 256/65; 256/59; 256/70

[58] Field of Search ..... 256/65, 70, 71, 59, 256/22; 403/252, 254, 255, 263; 24/243 E

[56] References Cited

U.S. PATENT DOCUMENTS

| | | | |
|---|---|---|---|
| 2,557,002 | 6/1951 | Lathrop | 256/65 |
| 2,576,055 | 11/1951 | Walsh | 24/243 E |
| 2,576,527 | 11/1951 | Matthysse | 24/243 E |
| 2,808,233 | 10/1957 | Spescha | 256/22 |
| 2,869,829 | 1/1959 | Spangberg | 256/65 |
| 3,313,527 | 4/1967 | Eriksson | 256/65 |
| 3,733,055 | 5/1973 | Hughes, Jr. | 256/65 X |
| 3,921,960 | 11/1975 | Bright | 256/65 |
| 3,962,774 | 6/1976 | Noro | 256/70 X |

FOREIGN PATENT DOCUMENTS

| | | | |
|---|---|---|---|
| 2606428 | 8/1977 | Fed. Rep. of Germany | 256/59 |

*Primary Examiner*—James Kee Chi

*Attorney, Agent, or Firm*—W. G. Fasse; W. W. Roberts

[57] ABSTRACT

A metal railing comprises railing sections. Each railing section has an upper hollow handrail, and a lower hollow girder. A center post joins the handrail and the lower girder, and a plurality of filler posts extend between and into the upper handrail and lower girder on each side of the center post. The filler posts are interconnected within the upper handrail and the lower girder by long pins. The railing sections are movably connected to coupling posts or end posts. A cable extends through the upper handrail and is clamped at the coupler posts and at the end posts.

12 Claims, 12 Drawing Figures

METAL RAILING

BACKGROUND OF THE INVENTION

This invention relates to a metal railing formed of sections, the sections comprising a closed or divided handrail adapted to receive a steel cable; at least one lower girder; and pinned filler bars supported at the inside of the upper wall of the handrail and at an inner wall of the lower girder. The railing sections are adapted to be supported movably at their ends by a pair of coupler posts, or by a coupler post and an end post. The center of the section is held by a center post. The sections preferably are fabricated substantially of light metal, such as aluminum.

German Pat. No. 1,003,937 discloses a railing structure, particularly for stairs, which consists of at least one hollow support section, a handrail detachably fastened thereto and, preferably, posts and filler bars. The posts and filler bars engage or reach into the support section and specifically extend through the bottom side of the supporting section. If an upper and a lower supporting section are used, for instance, the posts also extend through the lower supporting section. The upper supporting section and the lower supporting section are preferably of identical construction and configuration. However, the downwardly facing side of the bottom section is open, contrary to the corresponding downwardly facing side of the upper supporting section.

It is an essential feature of the structure of said German Pat. No. 1,003,937 that the posts and filler bars are connected to the two support sections, in a manner known per se, by pins which are inserted into transverse holes in the ends of the posts and filler bars, the pins being guided in lengthwise slots into inner surfaces of the supporting sections which face each other.

The posts and the filler bars were thereby secured against axial displacement as well as against rotation relative to each other.

Difficulties have been encountered in such railings in inserting the individual pins into the transverse holes of the filler bars, and in truly tightening them in the supporting sections. Railings of this type therefore had a tendency to develop rattling noises in the course of time and were expensive to install.

Modifications of this concept, particularly for the design of ladders, among other things, employ continuous rods instead of individual pins in the rungs. In such structures elastic deformation of the walls facing the rungs of the longitudinal beams was tolerated. As in the case of a railing, deformation of these walls is the same as deformations of the surfaces of the handrail and of the lower girder, which surfaces face each other. However, such deformations cannot be tolerated in the interest of preserving the possibility of a freely adaptable, simple installation of different railing units in sections of the total length of a railing structure. The deformation to be expected cannot be predetermined exactly, and imponderables in the manufacture and the material cannot be adequately eliminated in said known structure.

Railings required for the purpose of traffic safety, particularly for securing bridges, streets and railroad rights-of-way must therefore be designed according to other principles.

Thus, if a vehicle strikes the railing it is very important with respect to the extent of the damage, how large the bending moment of inertia is if the load is directed at the height of the railing girder or the handrail, and how large the torsion moment of inertia of the girders is, if the load is directed at the height of the filler bars in order to enable deflection of the load forces safely into the posts.

For this reason, special hollow sections were made as so called "handrail" sections, i.e. as railing girders, which are fabricated from light metal and generally exhibit optimum static values. In individual cases, steel cables are placed in these sections. The steel cables are clamped to the individual posts and serve as a safety reserve in the event that the limits of the railing are exceeded, even though the material is optimally employed. By such a time a large part of the motion energy is then already converted.

OBJECTS OF THE INVENTION

In view of the foregoing it is the aim of the invention to achieve the following objects singly or in combination:

to provide a railing of the above type which will not break down even under severe use conditions;

to construct the present railings of aluminum alloys, e.g. the alloy AlMgSi 0.5 F 25, which has an elasticity modulus of about 6,700 kg/mm$^2$ and other strength data which approach those of standard structural steel;

to include the filler bars or rods and their connections to the railing structure when considering the static conditions of the railing;

to employ a steel rope in a railing which is so secured that the guiding of the steel rope is assured even if the handrail and/or the posts should buckle;

to utilize as much as possible of a railing section for the take-up of impact energy;

to construct the connection or junctions between the filler rods and the top and bottom railings so that their strength is larger than the breaking strength of the filler rods as such;

to arrange the filler rods in such a manner that they are subject to the full impact of a vehicle or the like crashing into the railing;

to connect the filler rods in such a manner, that even if they break, they cannot separate from the railing structure;

to arrange the railing elements and their interconnections in such a manner that impact energy is transmitted to as many of the supporting posts as possible;

to construct the upper or handrail from two separate members which are connected in a force transmitting manner to form an integral upper railing;

to provide for an easy assembly of the entire railing structure and to control the deformations of the railing structure in response to impacts;

to construct a railing which is suitable for heavy duty use, for example, on bridges, roads, railroads and the like;

to use light metals, for example aluminum, and to nevertheless construct the railings strong enough for withholding vehicle impacts;

to provide means for fixing the position of the filler rods, as well as for adjustably securing the position of a steel cable; and to provide safe connection and guiding of the steel cable as part of the railing.

SUMMARY OF THE INVENTION

According to the invention the cross section of the filler bars is selected so that if they are stressed in the tension direction, their longitudinal elongation takes place before the perpendicularly related respective clamping surfaces in the handrail and the lower girder are bent. The filler bars engaging the handrail and the lower girder of each section on each side of the center post, starting from both ends of the railing unit, are connected with respect to tensile forces by long pins of cylindrical or prismatic cross section. In each railing unit, the construction provides form fit connections between the elements of a unit. In addition to such form fit connections, the handrail is connected to the lower girder by the long pins in a force transmitting manner.

Due to such a structure, one-half of a railing section supported by three posts is used fully for taking-up or dissipating the impact energy and the other half is at least partially used for this purpose through the handrail. In this regard, the force transmitting connections of the individual filler bars to each other by the pins is significant, since it ultimately transmits the stress from any individual elements to the system assembly. as heretofore, an impact hitting the railing perpendicularly, i.e., a simultaneous impact on different filler bars is handled better than an impact of the same intensity but applied at an acute angle and which is fully effective initially only against one filler bar. In that case, the optimum of the material utilization is reached if the margin of safety against breaking of the connections between the filler bars and the handrail and lower girder is higher than the margin of safety against breaking of the filler bar itself.

The arrangement according to the invention prevents the material of the filler bar from evading the load. It is fully effective for the energy conversion. Furthermore, it is ensured by the use of the long pin connection that in the event of a rupture of the girder or the handrail, the filler bars cannot separate from the remaining parts of the railing. Additional danger to traffic by filler bars strewn about and flung into the air is thereby eliminated.

In addition, a continuous cable is provided in the handrail and is fixed on the lower part of the joints of the indivdual posts or the lower part of the handrail in the vicinity of the posts under tensile loading. The individual connector elements for connecting the cable to the mentioned parts of the railing are adjustable with respect to their holding power.

In this regard the connecting elements for fixing the cable are adjusted so that the cable slips in the connecting elements before the permissible load is reached. By fixing the cable directly in the vicinity of the posts and providing a capability for adjusting the cable for a predetermined maximum holding force, the kinetic energy of an impact can be brokwn down via several posts.

The two filler bars which engage the handrail adjacent the two respective end or coupling posts are shortened by at least the dimension of the diameter of the cable installed in the handrail, and in this region the steel cable extends above this reduced length filler bar. The cable can thereby be run in this region over the upper end of a filler bar without a sharp bend in the cable at the connecting elements arranged in the handrail.

In order to fasten the ends of the cable, the individual posts are designed or can be equipped as cable end posts by inserting a filler piece or by encasing a solid rectangular section. The end of the cable can be bent relative to the handrail by 90° and fastened to the cable end post by several cable clamps arranged one above the other in the end post. A secure fastening of the cable is thus possible in the cable end post.

Complying with the sometimes encountered requirement of employing two-part handrails reduces the possible stress of the railing considerably. Such two-part handrails generally comprise a lower part and an upper part and facilitate the cable insertion, particularly in connection with repair work that may have to be performed. In the event of accidents, the upper part of the handrail has a tendency to become separated from the rest of the railing structure to thereby cause an additional traffic hazard and the released steel cable acts as a "saw" on anything in its path.

It is therefore advisable to run the cable in a closed, protective pipe and to construct the pipe so that it is an integral part of the handrail. The protective pipe is preferably inserted from the top into a slit or into a substantially closed groove of the handrail.

Independently thereof, it is advisable to comply with the requirement for divided handrails that the upper part forms a stop shoulder for the lower part, and that the lower part has a central groove. A clamping piece is provided with two outer grooves and a central tongue whereby the grooves and tongue are staggered in the lengthwise direction of the railing. The clamping piece is inserted into the upper part with the two grooves engaging supporting flanges of the upper part. The tongue extends into the center groove. The slots may extend over the top of the supporting shoulder. The upper and the lower part are connected by screws which extend through the lower part and engage the clamping piece.

The clamping piece is set at an angle of about 130° relative to the longitudinal direction of the railing. Due to the offset engagement of the clamping piece by the groove through the stop shoulder of the upper part and due to the engagement of the central key in the slot of the lower part, the effect of a closed profile is achieved along a large engagement length.

The upper and lower parts of the handrail are therefore anchored to each other in a force transmitting manner in the lengthwise direction and are engaged with each other in a form-fit manner in the vertical direction.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Before proceeding with a detailed discussion of the different embodiments of the invention, it must be understood that the invention incorporates railing sections adapted to be movably held at their respective ends by coupler posts or end posts. The metal railing sections include upper handrails through which a steel cable may be fed, the cables being clamped at the coupler posts and at the end posts. There are a number of variation possible for these components of the structure, some of which will be discussed in greater detail in the following paragraphs. In each case, however, the railing sections also have a lower girder, a center post extending centrally of the section between the upper handrail and the lower girder and a plurality of filler bars extending into the upper railing and the lower girder and spaced on each side of the center post. Further, in each case the filler bars on each side of a center post are joined by long pins within the respective upper handrail and lower girder.

Figure 1:
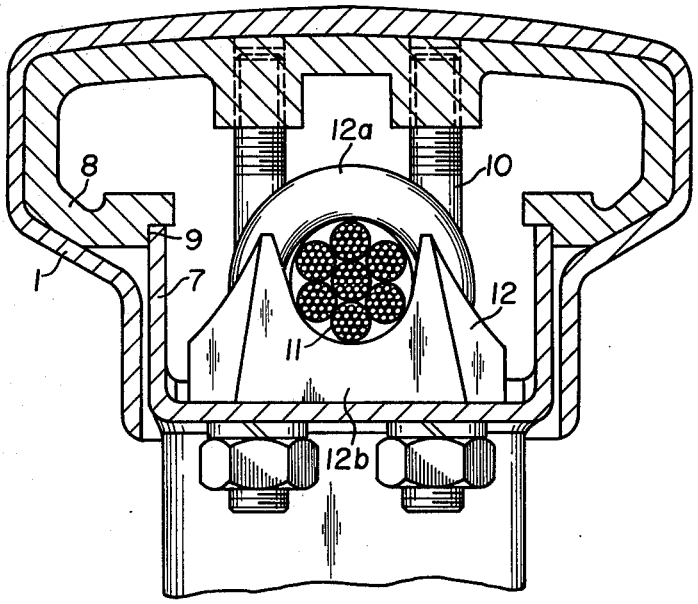
FIG. 1 is a cross sectional view of a handrail in accordance with one embodiment of the invention, showing a closed handrail section generally at a coupler post.
Figure 5:
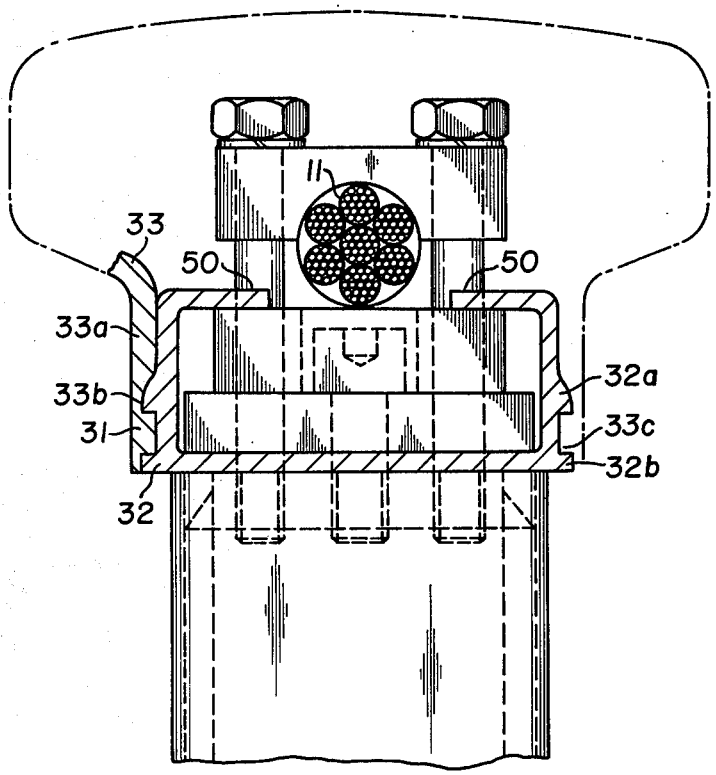
FIG. 5 is a cross sectional view of a modified handrail, in the region of a coupler post.
Figure 3:
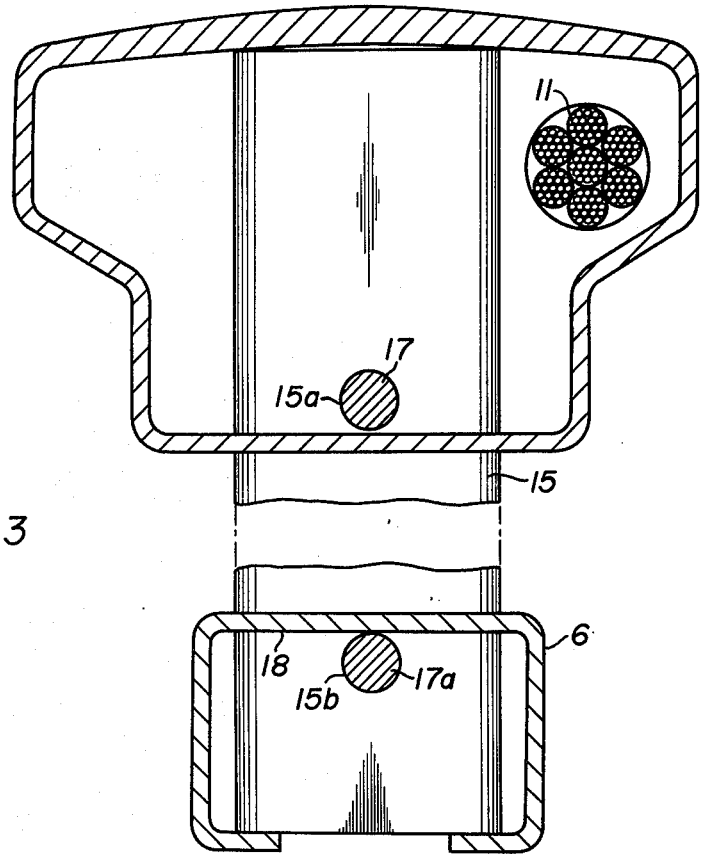
FIG. 3 is a cross sectional view of a railing section intermediate the posts, in accordance with the invention employing a handrail of the type illustrated in FIG. 1, the figure being shortened in the vertical direction for clarity.
Figure 4:
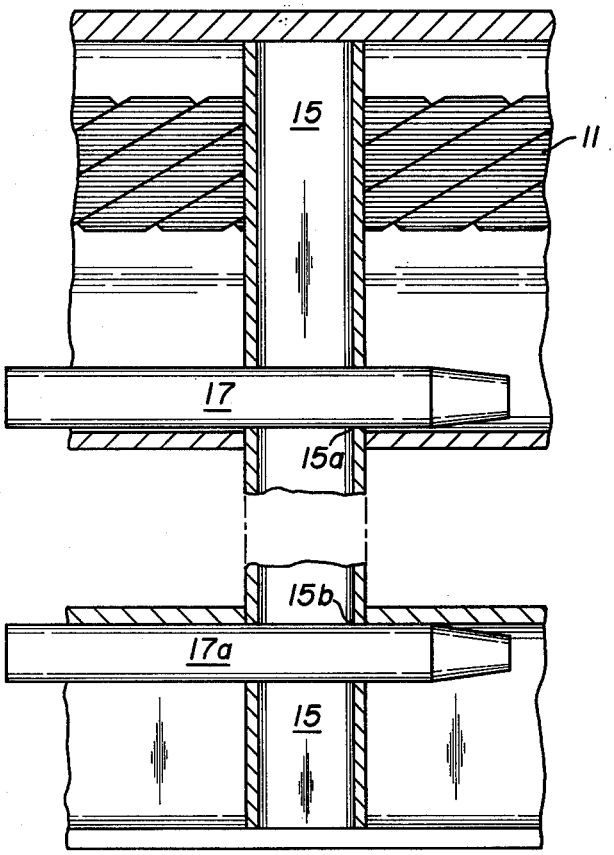
FIG. 4 is a cross sectional view of a metal railing generally in the region of a filler post, in a longitudinal plane of the structure.
Figure 6A:
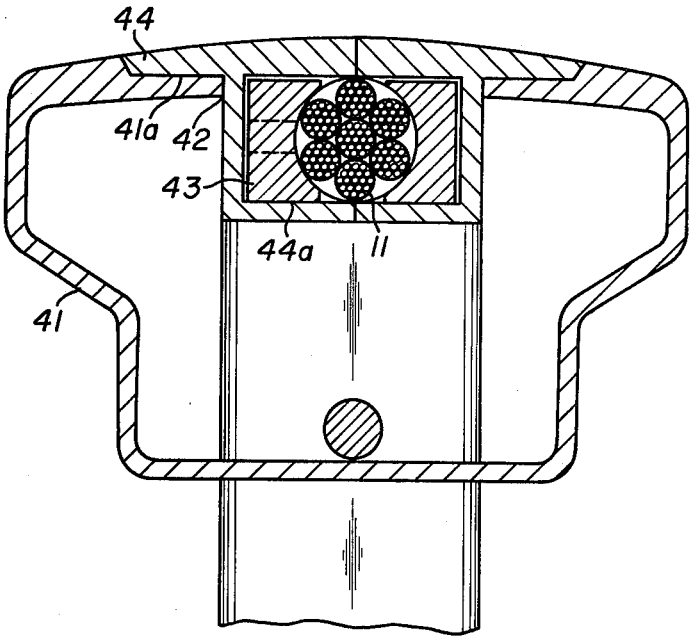
FIGS. 6A and 6B are cross sectional view of further modifications of a handrail which may be employed in the metal railing of the invention, these embodiments providing closed protective tubing for holding the cable.
Figure 6B:
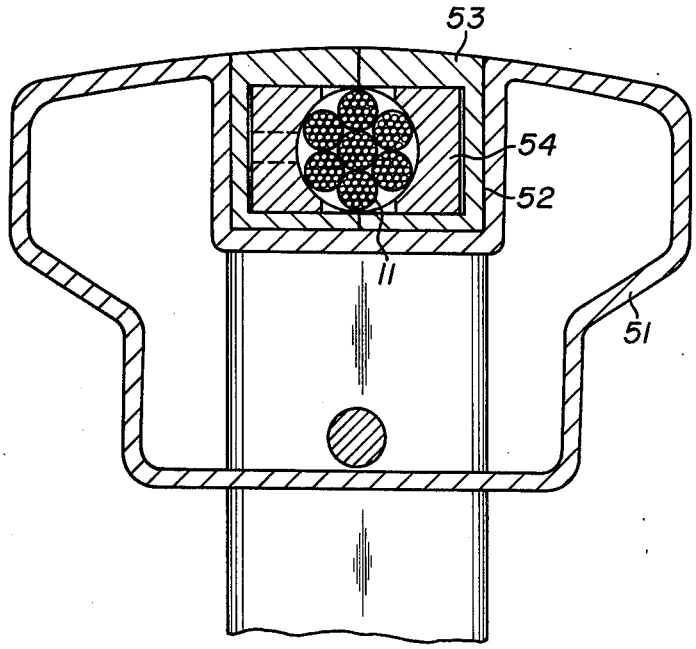
Figure 10:
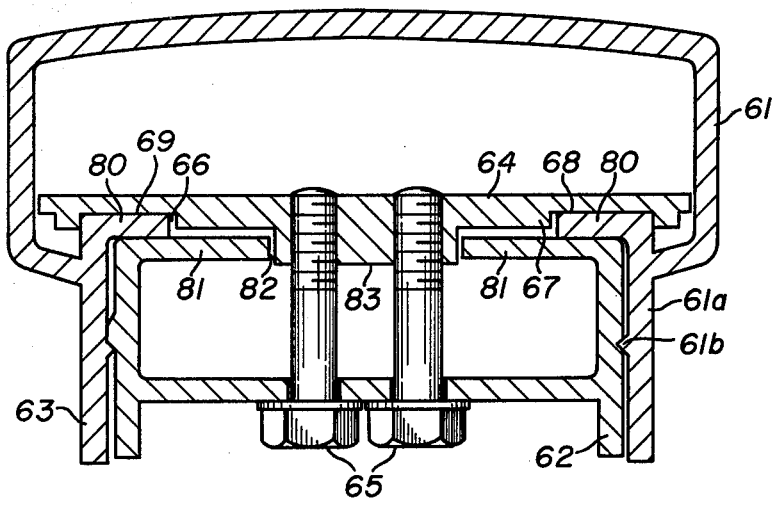
FIG. 10 is a cross sectional view of a still further embodiment of a handrail which may be employed in the railing of the invention.

While other forms of handrails may be employed, typical handrails are as follows:

(a) a handrail having a completely closed cross section, as ilustrated in FIGS. 1 and 3;

(b) a handrail having a divided cross section with an upper portion adapted to receive a lower portion at its underside, as illustrated in FIG. 5;

(c) a handrail having a two portion cross section, the major portion having a slot at its upper surface for receiving the second portion, and the second portion having a groove for receiving a protective case for the cable, as illustrated in FIG. 6A;

(d) a two part handrail wherein the major portion has a groove in its upper surface for receiving the second portion, the second portion having a slot for receiving the protective case for the cable, as illustrated in FIG. 6B;

(e) a two part handrail having a central clamping element for clamping the upper and lower portions together, as illustrated in FIG. 10.

In order to simplify the disclosure of the invention, it will first be explained in detail with reference to a structure having a closed handrail of the type illustrated in FIGS. 1 and 3, it being understood, of course, that the applicable features are also adaptable to the other types of forms of handrails. Thus, a railing section and an adjacent coupler post are most clearly illustrated in FIG. 7. As illustrated in this figure, a railing section comprises a hollow upper handrail member 1. The railing section further includes a center post 2 extending into the handrail 1 generally at its center, such that the upper end 2*a* thereof engages the upper inner wall 14 of the handrail. In some of the embodiments of the invention, as above discussed, the upper handrail may have inner transversely extending walls or partitions, and the term "upper inner wall" as employed herein may therefore also refer to these inner walls or partitions. Thus, a portion of the inside of the handrail extends over the top of and engages the top of the center post, to support the post 2. The bottom 2*b* of the handrail is designed in any suitable manner for supporting the railing section on a surface.

Figure 7:
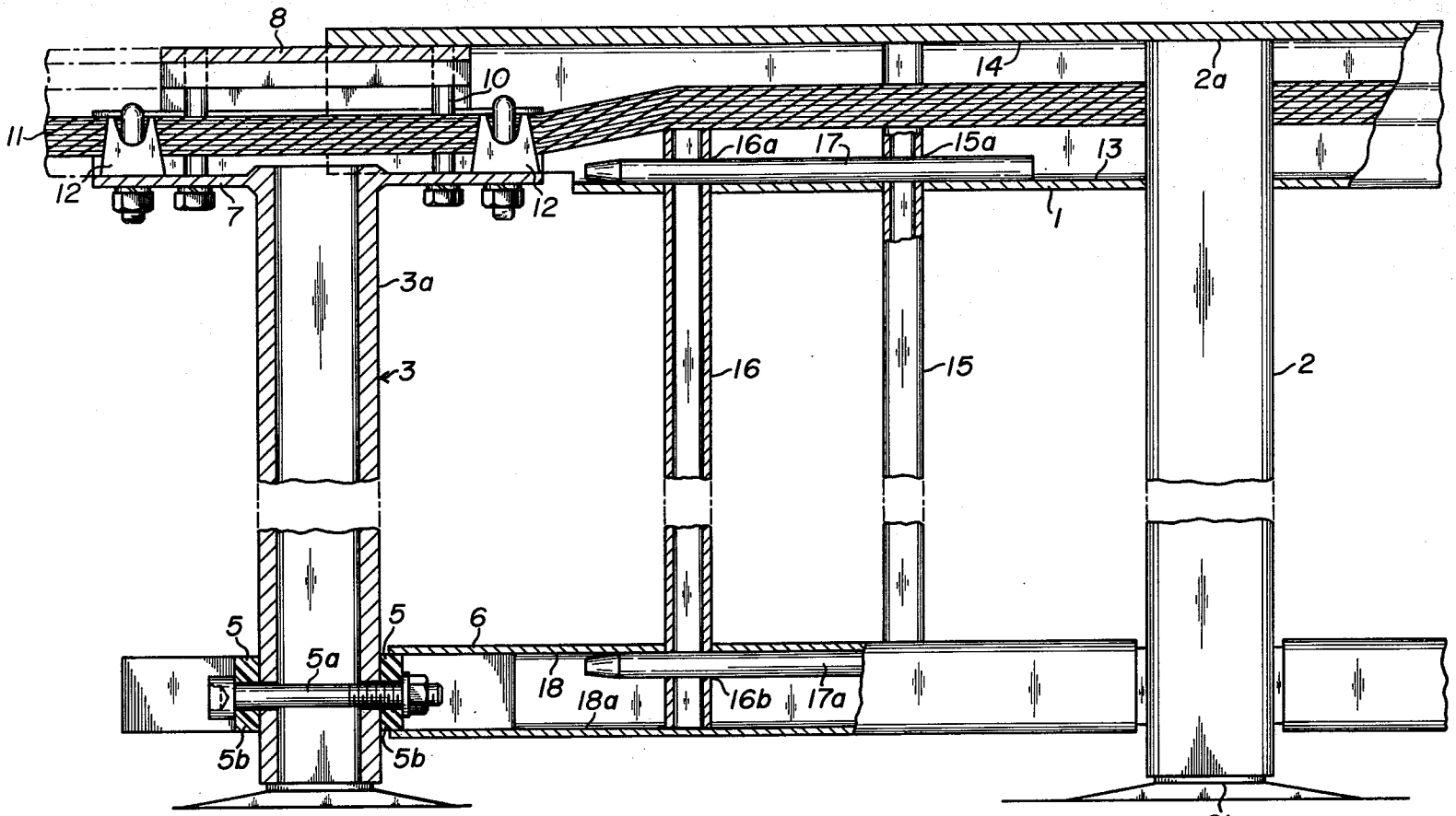
FIG. 7 is a partially cross sectional view of a metal railing section in the area extending between a coupler post and a center post, in accordance with the invention, and employing a handrail of the type generally illustrated in FIG. 1.

Each railing section further comprises a lower girder 6. As illustrated in FIG. 7, the lower girder 6 may comprise two portions extending in opposite directions from the center post and affixed thereto by any conventional means. For example, the lower girder 6 may be welded to the center post, or it may be affixed thereto by bolts. The lower girder 6 is hollow, as illustrated in FIG. 7, and has an upper wall 18 and a lower wall 18*a*. The exact configuration of the cross section of the lower girder is immaterial to the invention.

Each railing section further comprises one or more filler bars 15 extending generally parallel to the center post 2, between the upper handrail and the lower girder, on each side of a center post. The filler bars 15 extend through the lower wall 13 of the upper handrail, in the same manner as the center post 2, and into engagement with the upper inner wall 14 of the handrail, also in a manner similar to the center post 2. The filler posts 15 further extend through the upper wall 18 of the lower girder, and engage the upper surface of the lower wall 18*a* of the lower girder. This latter engagement is not illustrated in FIG. 7, although it is shown with respect to an end filler post 16. In addition, each filler post 15 has a hole 15*a* extending transversely therethrough at a distance from its upper end substantially corresponding to the vertical inner dimension of the upper handrail and a similar hole 15*b* (see FIG. 3) extending transversely therethrough at a distance from the bottom end of the filler bar substantially corresponding to the inner dimension of the lower girder. As is further indicated in FIG. 3, the lower girder 6 may have an open bottom. The open bottom facilitates the affixing of the various sections, for example, to the coupling posts or end posts, it being of course apparent that the opening is of insufficient width to permit the filler posts to extend therethrough.

Referring again to FIG. 7, the outermost filler bars 16, i.e. the filler bars most remote from the center post, are of the same configuration as the filler bars 15, and are mounted in the same general manner with the exception that the upper ends of these bars are somewhat shortened so that the bars do not extend to the upper wall of the handrail. This feature, as will be apparent in the following paragraphs, enables the passage of a steel cable 11 centrally in this portion of the handrail, so that a sharp bend in the cable will not be necessary. In other words, it is preferred that the cable 11 pass centrally through the railing at the coupling or end posts affixed to the railing structure, but the cable 11 may pass to the sides of the filler bars 15 and center post 2 in other regions of the railing, as illustrated in FIG. 3, for example, and the shortening of the filler bars 16 enables the cable to extend between these two positions without sharp bends. It will, of course, be apparent that this feature is not necessary in some embodiments of the invention, for example, where the inner upper wall of the handrail comprises a central partition, such that the cable may pass above such partition.

In accordance with the invention, as illustrated, for example, clearly in FIG. 7, the upper ends of the filler bars 15 and adjacent filler bar 16, on each side of the center post 2, are joined by a long pin 17 extending through the holes 15*a* of the filler bars 15, and the corresponding hole 16*a* of the filler bar 16. Similarly, a long pin 17*a* extends through the lower holes 15*b* of the filler bars 15, and through corresponding holes 16*b* of the filler bars 16 within the lower girder 6. The pins 17 and 17*a* may be installed, for example, by insertion through the open ends of the handrails and through the open ends of the lower girders of the railing sections during assembly. The pins 17 engage the upper surface of the lower inner wall 13 of the handrail 1, as illustrated in FIG. 7, and the pins 17*a* engage the lower surface of the upper wall 18 of the lower girder 6, as also illustrated in FIG. 7. This arrangement thereby enables the positive and rigid interconnection of the upper handrail and the lower girder. As a consequence, the filler bars 15 and 16 are interconnected with one another in a force transmitting manner. In other words, if a tensile force is applied to one of these bars, it will be coupled by way of the long pins 17 and 17*a* to the adjacent filler bars of the corresponding side of the center post. The holes through which the filler bars 15 and 16, as well as through which the center post 2 extend in the upper girder, closely fit the respective bars and posts, and the corresponding holes in the lower girders also closely fit the filler bars extending therethrough.

Figure 8:
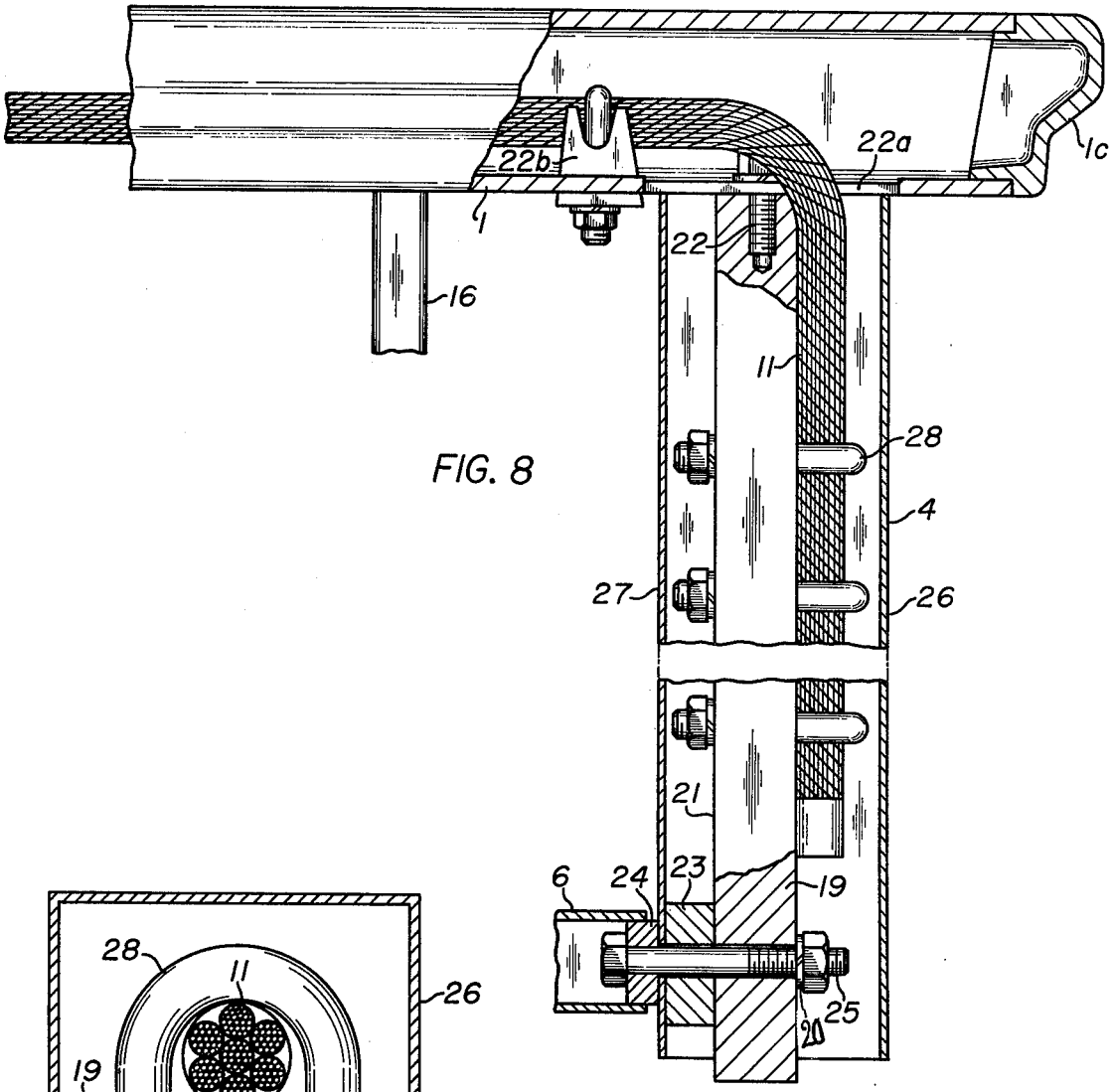
FIG. 8 is a partially cross sectional view of an end post which may be employed in the metal railing of the invention.
Figure 9:
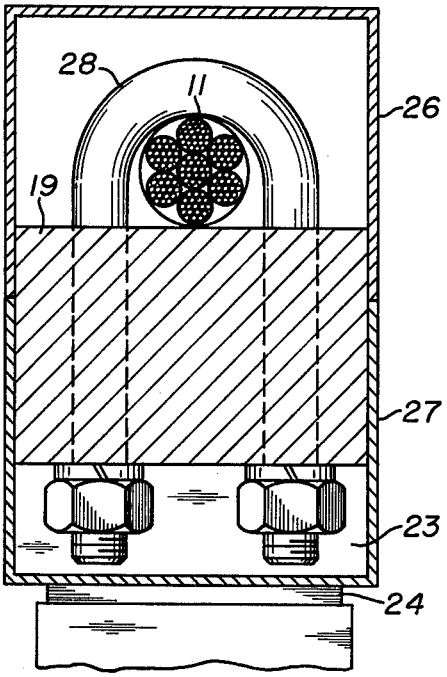
FIG. 9 is a transverse cross sectional view of the end posts of FIG. 8.

As discussed above, the ends of each railing section may be connected to either a coupler post 3 as illustrated in FIG. 7, or an end post 4, as illustrated in FIGS. 8 and 9. Of these posts, at least the coupler post 3 is designed to take up length changes in the structure due to expansion and contraction. The coupler posts 3 may comprise an aluminum encased galvanized square steel tube 3*a* set in concrete in accordance with the usual specificaions. The center posts 2 may likewise comprise galvanized, aluminum encased square steel tubing. The sides of the tube 3*a* are provided, at their lower ends, with expansion joints 5 of conventional nature adapted to be connected to the ends of the lower girder 6. For example, the expansion joints 5 may comprise a bolt 5*a* extending through the lower portion of the post 3*a*, for holding resilient washers 5*b*, which resiliently engage the inner surfaces of the girders 6 coupled thereto.

Figure 2:
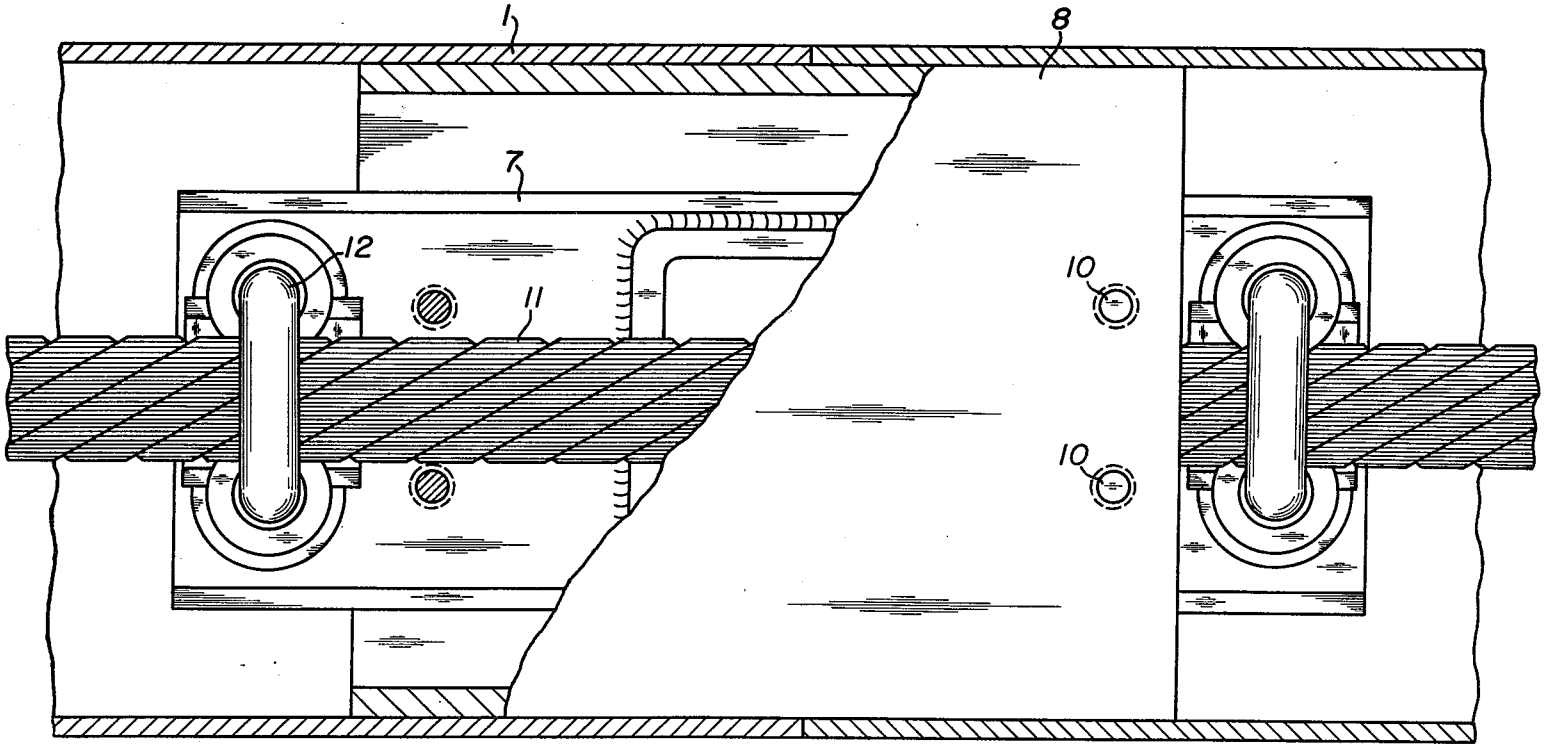
FIG. 2 is a top view of the handrail of the type illustrated in FIG. 1, at a coupler post, with portions thereof broken away to more clearly show the structure.

The upper end of the tube 3*a* is welded to the lower part 7 of a joint. The lower part 7 of the joint has a U-shaped cross section, as illustrated in FIG. 1, and the upper part 8 of the joint, as illustrated in FIGS. 1 and 3, extends over this lower portion and has guiding elements 9, such as a guide slot, engaging the upper ends of the U-shaped lower part 7. The upper part 8 thereby extends over the U-shaped profile of the lower part. A cable clamp 12 is provided at each end of the lower part 7, for clamping the cable 11 to its upper surface, as illustrated in FIG. 2, the upper part 8 preferably not extending lengthwise as far as the distance between the cable clamps as shown in FIG. 2. The upper part 8 of the joint is bolted to the lower part 7 by means of studs 10 which extend downwardly on each side of the cable 11, and through the lower part 7. Thus, the steel cable 11 extends centrally between the studs 10, and is fixed in a force transmitting manner by the cable clamps 12. As is apparent in FIGS. 1, 3, and 7, the joint comprising the parts 7 and 8 extends into the upper handrail 1, for movably supporting the upper handrail. The parts 7 and 8 of the joint preferably have an external cross section similar to that of the inside of the handrail. As is apparent from FIG. 2, the cable 11 passes centrally of the handrail in the region of the coupler posts, and it was for this reason that the filler bars 16 of the railing sections did not have full lengths, so that the cables could extend to their sideways positions as illustrated in FIG. 3, over a distance corresponding to about twice the filler bar spacing.

As illustrated in FIG. 1, the cable clamp 12 may be of conventional construction, and be formed of a threaded U-shaped bolt 12*a* inverted to extend downwardly through the lower part 7, to hold the cable 11 against the shaped cable block 12*b*.

The cable end post 4, as illustrated in FIGS. 8 and 9 comprises a continuous vertical supporting part 19 formed, for example, of galvanized steel having a square or rectangular cross section. A plurality of fastening elements, such as U-bolts 28, extend through the part 19, to clamp the cable 11 at three vertically spaced apart and aligned positions. The cable is thereby firmly clamped against the surface of the part 19 away from the railing section. The nuts for the U-shaped bolts are thereby tightened against the surface 21 of the part 19 toward the railing sections. The vertical supporting part 19 is bolted to the handrail 1, for example, by means of a bolt 22 extending through the lower wall of the handrail, the lower wall of the handrail having an aperture 22*a* enabling the cable 11 to be bent downwardly to be clamped to the part 19. In order to facilitate the bending of the cable, a conventional U-clamp 22*b* may be provided within the handrail adjacent the end post, for clamping the cable within the handrail. In the arrangement of FIGS. 8 and 9, the end post is thereby positively interconnected to the handrail, so that expansion must be taken up exclusively by the coupler posts. It is, of course, apparent that the handrail may alternatively be designed so that it also can compensate for expansion forces.

The lower girder 6 is connected to the end post 4 by way of a filler element 23, as shown in FIGS. 8 and 9, the filler element 23 being bolted to the surface 21 of the supporting part 19, by means of bolts 25. The bolts 25 may hold sliding element 24 for slidably receiving the ends of the lower girder 6. The cable clamping devices 28 and the connection to the lower girder, i.e., the filler 23, may be protected by U-shaped aluminum covers 26 and 27, as illustrated in FIGS. 8 and 9. These covers may be held by any conventional technique.

As further illustrated in FIG. 8, a suitable end cap 1*c* may be provided on the end of the handrail 1.

As discussed above, in the arrangement of the invention illustrated in FIGS. 1 and 3, the handrail 1 may comprise a tubular section of closed cross section. The lower portion of the tube is cut out at the ends thereof, for receiving the coupler and posts as shown in FIG. 1. Alternatively, as illustrated in FIG. 5, the upper portion 33 of the handrail may be separate from the lower portion 32 thereof. Thus, the upper portion may have downwardly extending side portions 33*a* with internal grooves 33*b* for receiving and holding corresponding ridges 32*a* of the lower portion. The outer edges 32*b* of the lower portion may be received by parallel guide recesses 33*c* at the bottom of the upper portion 33. Since the handrail of FIG. 5 is formed in two portions, which may be snapped or otherwise held together, a different form of cable clamp may be provided, as illustrated in FIG. 5. In other words, the cable clamp structure may be provided with bolts accessible from above. This portion of the structure is not disclosed in detail, however, since it does not form a part of the invention per se. It will be noted, however, that the lower portion 32 defines a partial intermediate wall 50, which may, if desired, define the inner upper wall surface against which the filler bars and center posts rest. In this instance it is, of course, unnecessary for the end filler bars 16 to be shortened.

The two part handrail of FIG. 6*a* has a lower portion 41 which is substantially continuous and extends to and defines a portion of the upper wall of the handrail. This lower portion has a central longitudinally extending slot 42 for receiving the upper portion 44 of the handrail. For this purpose, a recess 41*a* may be formed in the upper surface of the part 41, for supporting the transversely extending flange portion of the upper part 44. The upper part 44 has a longitudinally extending slot 44*a* for receiving the protective casing 43 for the cable 11.

In the alternative arrangement of FIG. 6*b*, the upper handrail has a lower portion 51 which extends to define a portion of the upper surface of the handrail, this upper surface having a closed center slot 52 for receiving the upper portion 53. The upper portion 53 has a longitudinally extending slot for receiving the protective casing 54 for the steel cable. In the arrangements of FIGS. 6*a* and 6*b*, the portions 44 and 53 respectively may be split in the commercial manner to receive the protective casing, or they may be unitary and provided with a longitudinally extending hole to receive the protective casing. Further, in the arrangement of FIGS. 6*a* and 6*b*, the lower surfaces of the portion 44 or the lower portion of the wall section defining the groove 52 respectively, may define the inner upper wall surface against which the filler bars and/or center post abut. In this case, it is once again unnecessary to provide filler bars of different lengths.

Figure 11:
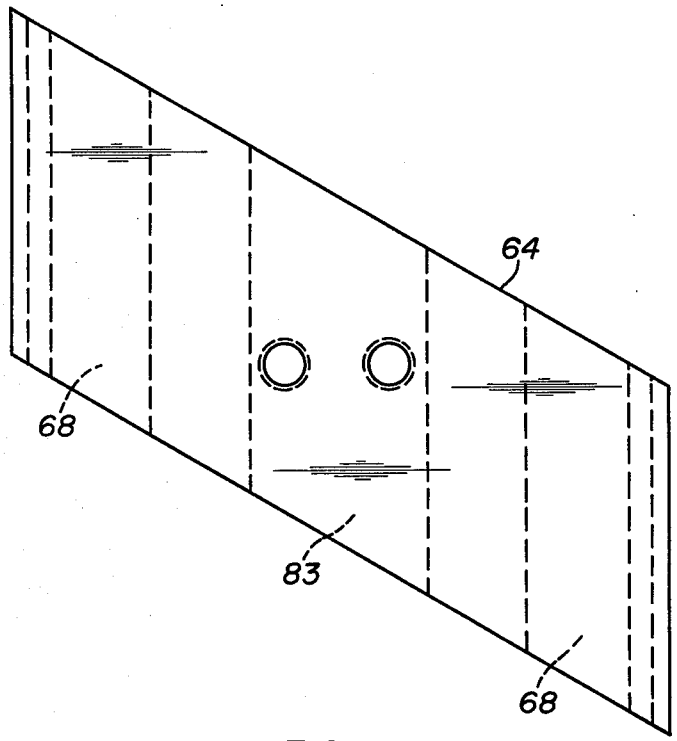
FIG. 11 is a top view of a clamping piece which may be employed with the handrail of FIG. 10.

The handrail of FIGS. 10 and 11 is somewhat similar to that of FIG. 5, in that the upper portion of the handrail has downwardly extending parallel portions 61*a* with internal longitudinally extending ridges 61*b* for receiving and clamping the lower portion 62. In this arrangement, the upper handrail portion 61 has inwardly extending portions 80 spaced from its bottom end, to define a longitudinally extending slot 66, the portions 80 also defining support flanges or shoulders 69. The upper portion of the lower handrail part 62 also has inwardly extending flanges 81 which define a central slot 82, whereby the upper surface of the flanges 81 abuts the shoulder 69 of the upper part 63. The upper and lower parts of the handrail are held together in this position by means of a plurality of clamping plates 64, such as shown in FIGS. 10 and 11. The clamping plates 64 are preferably uniformly distributed in the handrail sections between the posts, so that, for example, five to six clamping pieces may be arranged between adjacent posts, if the posts are spaced about 1400 mm apart.

The clamping pieces 64 are preferably parallelogram shaped, as illustrated in FIG. 11, to extend obliquely within the upper handrail part. The lower surface of the clamping plate 64 is provided with longitudinally extending grooves 68 adapted to engage the upper surfaces of the inwardly extending flanges 80, whereby the clamping piece extends downwardly through the center slot 66, the clamping plate 64 effectively forming a key 67 in this region. In addition, the clamping plate 64 has a central downwardly extending key portion 83 which extends downwardly through the slot 82 of the lower portion. The bolts 65 extend upwardly from the bottom of the lower portion 62 and into the clamping plate 64 in the region of the key 83, in order to clamp the upper and lower portions of the handrail together.

As discussed above, the clamping plates 64 preferably extend at an angle of about 130° relative to the longitudinal direction of the railing.

Further, as discussed above, it is an important feature of the present invention that the filler bars have cross sections such that their tensile strength enables elongation thereof, when they are subjected to tensile forces, before deformation occurs in the corresponding transverse walls of the upper railing and lower girder. In other words, when the railing is subject to forces, for example, due to impact by a vehicle, which results in the application of tensile forces to the filler bars, these bars will be deformed before deformation occurs in the lower wall of the upper rail and the upper wall of the lower girder, due to the engagement of the sides of the pins with these walls.

Although the invention has been described with reference to specific example embodiments, it is to be understood, that it in intended to cover all modifications and equivalents within the scope of the appended claims.

What is claimed is:

1. A heavy duty metal railing including at least one railing section comprising a hollow upper rail having a lower inner wall, cable means received in said hollow upper rail, at least one hollow lower girder spaced from said upper rail and having an upper inner wall, a center post extending between said upper rail and lower girder, and a plurality of filler bars spaced on each side of said center post, said filler bars having upper ends extending into said upper rail and lower ends extending into said lower girder, a first elongated pin means extending longitudinally in said upper rail and through each end of each filler bar as well as in contact with said lower inner wall of said upper rail of a railing section, a second elongated pin means extending longitudinally in said lower girder and through each lower end of each filler bar as well as in contact with said upper inner wall of said lower girder of a railing section, said first and second pin means interconnecting all the filler bars on the respective side of the center post by a wedging action against the respective inner wall defining a clamping surface to thereby provide a chain formation, in which said filler bars are positively connected to each other through said pin means in a force transmitting manner and whereby said upper rail and said lower girder are also integrated into said chain formation and coupled to each other in a force transmitting manner.

2. The metal railing of claim 1, in which said filler bars have corss-sectional dimensions such that tensile forces therein effect an elongation of said filler bars prior to bending of the respective clamping surfaces of said upper rail and lower girder.

3. The metal railing of claim 1, further comprising a post coupled to an end of said railing section and defining a joint at said upper rail, and further comprising a cable extending through said upper rail, and clamping means at said joint for clamping said cable.

4. The metal railing of claim 3, wherein said clamping means is adjustable, whereby said cable may slip under tensile loads exceeding a given, adjustable clamping force.

5. The metal railing of claim 1, wherein a cable extends through said upper rail, said cable extending along the side of said filler bars, and further comprising additional filler bars at the ends of said section away from said center post, said additional filler bars being connected to said first mentioned filler bars by said pen means, the upper ends of said additional filler bars being spaced from said upper inner wall surfaces of said upper rail, whereby said cable may extend between said additional filler bars and said upper inner wall surface.

6. The metal railing of claim 1, further comprising an end post coupled to one end of said railing section, said end post having a solid rectangular vertical element, said cable being deflected 90° from said upper rail to extend vertically along said end post, and clamping means arranged on said end post for clamping said cable against said end post.

7. The metal railing of claim 1, further comprising a protective means at least partially surrounding said cable, said protective means comprising an integral part of said handrail.

8. The metal railing of claim 1, wherein said upper rail comprises a closed metal tubular section.

9. The metal railing of claim 1, wherein said upper rail comprises separate upper and lower portions and means operatively interconnecting said upper and lower portions.

10. The metal railing of claim 9, wherein said upper rail portion has a stop shoulder for engaging said lower rail portion, said lower rail portion having a central groove, and further comprising a clamping element having outer grooves with support flanks and a central tongue extending into said central groove of said lower rail portion, said support flanks of said outer grooves of said clamping element being staggered in the longitudinal rail direction, said central tongue extending between said supporting flanks, said interconnectng means including bolt means for securing said lower portion to said clamping element for clamping said upper and lower portions together.

11. The metal railing of claim 10, wherein said clamping element comprises a clamping plate extending obliquely to the longitudinal direction of said railing.

12. The metal railing of claim 10, wherein said bolt means extend through the lower rail portion.

* * * * *